US005568713A

United States Patent [19]

Gagne et al.

[11] Patent Number: 5,568,713

[45] Date of Patent: Oct. 29, 1996

[54] MIRROR DOOR AND METHOD OF MAKING SAME

[75] Inventors: Robert J. Gagne, Glastonbury; William J. Plein, II, South Windsor, both of Conn.; Kenneth Carson, Shannon, Miss.

[73] Assignee: The Stanley Works, New Britain, Conn.

[21] Appl. No.: 590,787

[22] Filed: Jan. 24, 1996

[51] Int. Cl.[6] ..... E06B 3/72

[52] U.S. Cl. ..... 52/785.1; 52/784.1; 156/314

[58] Field of Search ..... 52/784.1, 785.1; 156/314

[56] References Cited

U.S. PATENT DOCUMENTS

| | | |
|---|---|---|
| 3,075,255 | 1/1963 | Taubman . |
| 3,305,992 | 2/1967 | Steed . |
| 3,404,502 | 10/1968 | Miller . |
| 3,533,671 | 10/1970 | Huber . |
| 4,236,365 | 12/1980 | Wheeler . |
| 4,513,553 | 4/1985 | Barry . |
| 4,624,094 | 11/1986 | Schwindt . |
| 5,074,087 | 12/1991 | Green . |
| 5,175,970 | 1/1993 | Green . |
| 5,355,654 | 10/1994 | Stanley ..... 52/784.1 |

*Primary Examiner*—Carl D. Friedman
*Assistant Examiner*—Yvonne Horton-Richardson
*Attorney, Agent, or Firm*—Pepe & Hazard

[57] ABSTRACT

A mirror door comprising a door with opposed faces, one of which has a recess therein, and a mirror seated within the recess. The mirror has a light reflective front face and a rear face disposed against the door, and is cooperatively dimensioned with the recess to locate its periphery adjacent the periphery of the recess. The mirror is secured in the recess of the door by two adhesives. The first rigid adhesive is disposed between the peripheral portions of the rear face of the mirror and the door recess, and the second adhesive is disposed between the mirror and door inwardly of the peripheral portions. The first adhesive is relatively rigid in comparison to the second adhesive to mount the mirror on the door in a fixed position, and the second adhesive is relatively flexible to accommodate differential expansion between the door and mirror and to dampen impact forces acting between the door and mirror. A method for making a mirror door is also provided.

12 Claims, 1 Drawing Sheet

MIRROR DOOR AND METHOD OF MAKING SAME

BACKGROUND OF THE INVENTION

The present invention relates to mirrored doors, and, more particularly, to methods of mounting a mirror in a large recess in a door face.

Mirrors or doors with mirrors on a face thereof are widely employed in bedrooms and dressing rooms to enable viewing of attire on the wearer, to enhance the appearance of rooms, or to provide special effects. In some instances, the mirror itself comprises a sliding panel, or is mounted in a peripheral frame, to provide a sliding door. In swinging doors and in some sliding doors, the mirror is mounted upon the face of a wooden door by clips or by a peripheral molding secured to the underlying door face.

Adhesive mounting of glass mirrors on a door face presents a problem because of the weight of the mirror and its differential expansion relative to the door panel. Swinging doors provide a further problem in that impacts resulting from closing of the door may fracture the mirror. Concern over the possibility of the shattering of the mirror has resulted in the adhesive bonding of a tough plastic film to the rear surface of the mirror.

As used herein, "wood" or "wooden" include molded hardboard, particle board and laminates of wood, plastics and other materials.

Accordingly, it is an object of the present invention to provide a novel mirror door having a mirror adhesively mounted within a recess in an underlying wooden door.

It is also an object to provide such a mirror door having adhesive bonds which will withstand static and impact loads and accommodate differential expansion of the mirror and door as a result of humidity and thermal changes.

Another object is to provide such a mirror door which may be fabricated readily and relatively economically.

Yet another object is to provide such a mirror door having adhesive bonding which will withstand impacts caused by slamming the door, dampen the impact forces transmitted from the door to the mirror, and eliminate the need for a plastic safety film on the mirror back.

A further object is to provide a novel method for making mirror doors, which is both easily practiced and is economical.

SUMMARY OF THE INVENTION

It has now been found that the foregoing and related objects may be readily attained in a mirror door comprising a door with opposed faces, one of which has a recess therein, and a mirror seated within the recess. The mirror has a light reflective front face and a rear face disposed against the door, and the periphery of the mirror is located adjacent the periphery of the recess.

The mirror is secured in the recess of the door by two adhesives. The first rigid adhesive is disposed between the peripheral portions of the rear face of the mirror and the door recess, and the second adhesive is disposed between the mirror and door inwardly of the peripheral portions. The first adhesive is relatively rigid in comparison to the second adhesive to mount the mirror on the door in a fixed position, and the second adhesive is relatively flexible to accommodate differential expansion between the door and mirror and to dampen impact forces acting between the door and mirror.

Preferably, sealant is disposed about the periphery of the mirror to effect a seal thereabout, and the first adhesive is substantially impermeable to moisture. Generally, the mirror is made of glass and has a silver reflective coating on the rear face and the first and second adhesives are chemically inert to the silver reflective coating. Desirably, the door is made of wood and the faces of the door are provided by molded hardboard skins.

A method for making a mirror door comprises the steps of providing both a door having opposed faces with a recess in one of the faces and a mirror dimensioned cooperatively with respect to the recess. The mirror has a light reflective front face and a rear face and the periphery of the mirror is located adjacent to the periphery of the recess. The mirror is secured in the recess of the door by first applying a first rigid adhesive between the peripheral portions of the rear face of the mirror and of the door recess. Next, a second adhesive of greater flexibility is applied between the mirror and door inwardly of the peripheral portions. The first adhesive is relatively rigid in comparison to the second adhesive to mount the mirror on the door in a fixed position, and the second adhesive is relatively flexible to accommodate differential expansion between the door and mirror and to dampen impact forces acting between the door and mirror.

Generally, both the first and second adhesives are applied to the mirror before its placement in the recess of the door, and the second adhesive is spaced from the first adhesive.

Preferably, the mirror and recess are cooperatively dimensioned so that the mirror is snugly seated in the recess.

Desirably, the door providing step is effected by assembling to a frame molded hardboard skins, one of the skins being molded with the recess.

The method may include the step of applying a sealant about the periphery of the mirror.

BRIEF DESCRIPTION

DETAILED DESCRIPTION OF THE PREFERRED EMBODIMENT

Figure 1:
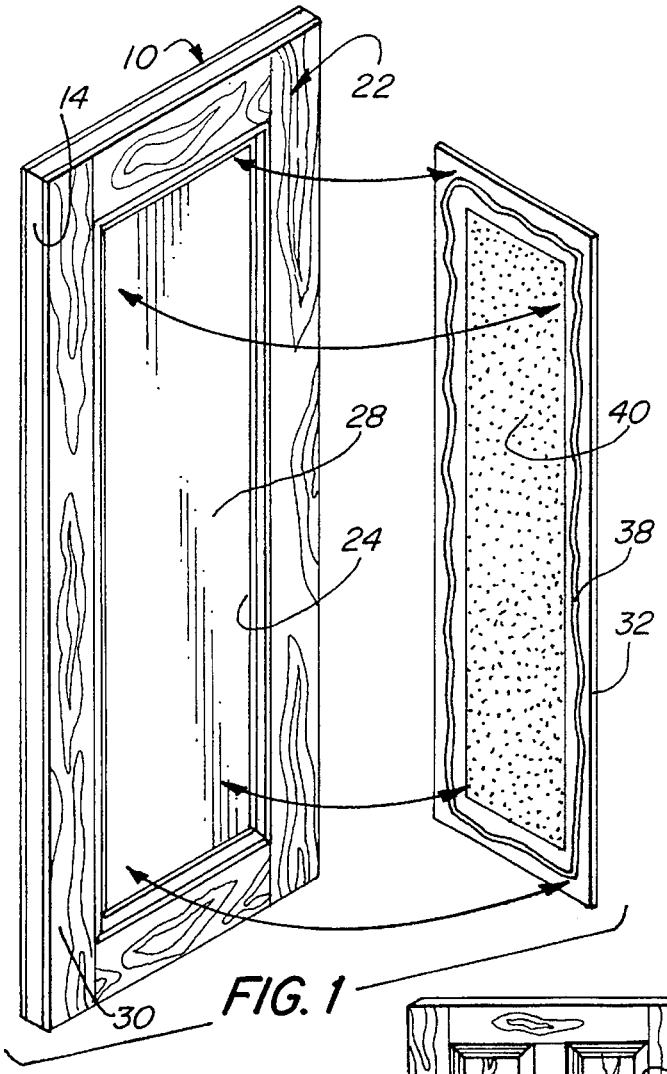
FIG. 1 is an isometric view of a mirror door embodying the present invention prior to placement of the mirror within the recess of the door.
Figure 2:
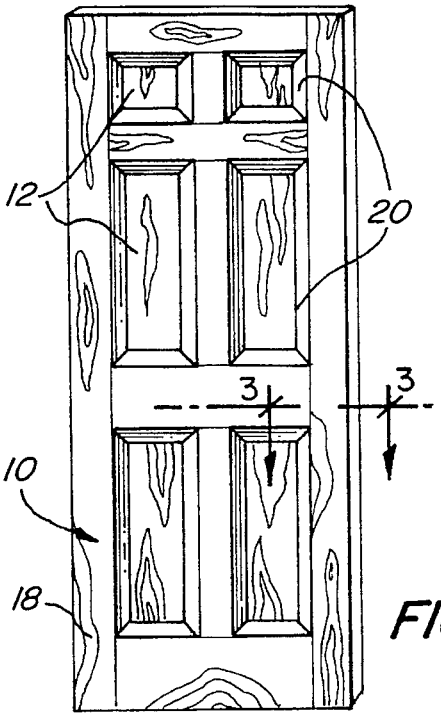
FIG. 2 is an elevational view of the other face of the door of FIG. 1.

Turning first to FIGS. 1 and 2, therein illustrated is a mirror door embodying the present invention which has one face provided by a rear skin generally designated by the numeral 10 with a series of raised panels 12 formed therein.

Figure 3:
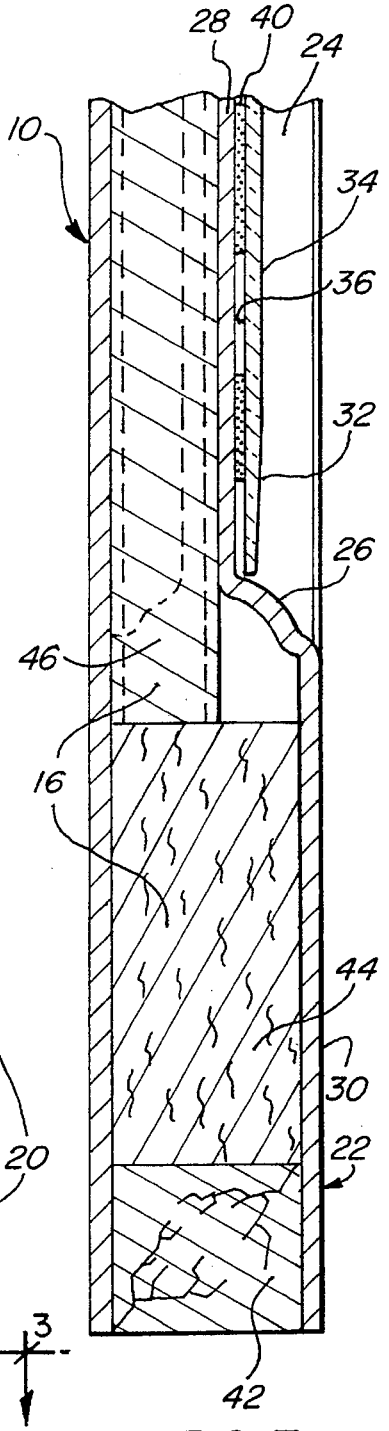
FIG. 3 is a fragmentary sectional view along line 3-3 of FIG. 2 drawn to a greatly enlarged scale.

In accordance with conventional manufacturing processes, this is conveniently a door with molded hardboard skins mounted upon a peripheral frame 14 and blocks 16 (seen in FIG. 3). The door rear skin 10 is desirably molded with a wood grain pattern indicated by the areas bearing the numeral 18 and lines 20 simulating the abutment of wooden sections.

Figure 4:
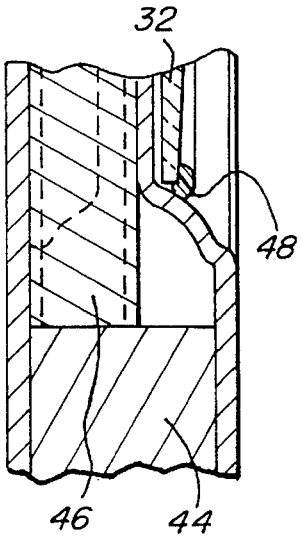
FIG. 4 is a fragmentary sectional view of a portion of the section in FIG. 3 with a bead of caulk, wood or plastic molding about the periphery of the mirror.

The opposite face of the door has a molded front skin generally designated by the numeral 22 providing a single large recess 24 having a peripheral wall 26 extending between the front planar base wall 28 of the recess 24 and the peripheral surface 30 of the skin 22. The peripheral wall 26 is inclined outwardly and desirably non-rectilinear as seen in FIGS. 3 and 4.

Conventionally, the rear and front skins 10, 22 respectively, are bonded to the frame 14 and blocks 16 by adhesive (not shown). The stiles and rails of the frame 14 are fabricated from wood, and the blocks 16 are conveniently fabricated from wood, synthetic resin foam, pressed wood, or honeycomb material. Generally, the front skin 22 will also be molded with a wood grain pattern 18.

Seated in the recess 24 is a mirror 32 which has the same rectangular configuration as the recess 24, but it has slightly smaller dimensions than the recess 24 so that it may be placed therewithin on the base wall 28 with the periphery closely adjacent to the peripheral wall 26. The mirror 32 has a reflective front face 34 which is oriented outwardly when assembled in the recess 24, and a rear face 36 which is disposed adjacent the base wall 28.

The mirror 32 is adhesively secured to the front skin 22 by two distinct adhesive coatings 38 and 40 disposed therebetween and shown in FIG. 1 as applied to the rear face 36 of the mirror 32. The two adhesives 38 and 40 have different performance characteristics which complement each other. Adhesive 40 covers most of the area of the rear face 36 and is relatively flexible. In contrast, adhesive 38 covers a relatively small portion of the area of the rear face 36 adjacent the periphery of the mirror 32 and is relatively rigid. As seen in FIG. 1, adhesive 38 is applied as a bead which will spread laterally under pressure when placed against the base wall 28.

The relatively rigid adhesive 38 characteristically has a higher tensile strength than the more flexible adhesive 40. As a result, the rigid adhesive 38 rigidly affixes the mirror 32 to the skin 22 and prevents the front mirror 32 from moving relative to the front skin 22. Moreover, the location of the rigid adhesive 38 about the periphery of the rear face 36 of the mirror 32 causes the front mirror 32 to act as a rigid support for the skin 22 to eliminate substantially any warping of the front skin 22.

Turning now in detail to FIG. 3, therein fragmentarily illustrated is a horizontal cross section of the mirror door at the lock side. The stile 42 of the door frame 14 is made of wood and a wooden block 44 to support the lock set (not shown) abuts the inner edge of the stile 42, and extends inwardly therefrom between door skins 10, 22 respectively, until it abuts the rear and front peripheral wall 26 of the recess 24. Thinner blocking 46 extends between the rear skin 22 and the front skin 10 behind the mirror 32. The blocks 16 add to the overall structural rigidity of the hollow core door and prevent the door skin 10 from warping.

The inwardly tapering peripheral wall 26 of the recess 24 facilitates insertion of the mirror 32 and provides an attractive appearance. In addition to the aesthetics of this mounting arrangement, the mirror 32 is protected from impacts upon its edges which could easily chip the edge or even dislodge the mirror 32.

To further enhance the appearance and sealing of the rear face 36 of the mirror 32 from the environment, a bead of caulk or wood or plastic molding 48 may be placed about the peripheral edge of the mirror 32 as seen in FIG. 4. Alternatively, the bevelled edge of the mirror may be sealed by a lacquer or other sealant, and/or a wood or plastic molding may be placed over the edge.

It will be appreciated that the adhesive bond between the mirror and the door must withstand a variety of forces including the static load generated by the weight of the mirror. The rigid adhesive 38 with its relatively high tensile strength, is designed to handle the static load of the mirror 32 and withstand the effects of creep. In addition to its rigidity, the rigid adhesive 38 should be one which is relatively impervious to moisture to serve as a moisture barrier to prevent humidity from attacking the flexible adhesive 40 and the silver coating.

The flexible adhesive 40 has performance characteristics which are different from, but complimentary to those of the rigid adhesive 38. It will stretch while maintaining the bond between the panel and the mirror. This flexibility enables the adhesive 40 to accommodate the differential expansion coefficients between the door, made of wood with a relatively high coefficient of thermal expansion, and the mirror which is made of glass with a relatively low coefficient of expansion. In addition, exposure to humidity may also cause the wood in the door to warp. If the adhesive bond between the proper surface area of the mirror and the door were too rigid, the mirror would be subject to large stresses and might fracture.

The relatively flexible adhesive 40 also cushions the mirror from impacts, such as those caused by slamming the door. The flexible adhesive 40 deforms and absorbs the energy from the impact of the door, thereby attenuating the impact force which reaches the fragile mirror. Since adhesive 40 is applied over most of the middle surface of the rear face 36 of the mirror 32, it is able to accommodate both differential expansion over most of the mirror, and cushion most of the mirror from high impact forces.

In addition to its complimentary performance characteristics, the flexible adhesive 40 is relatively less expensive and easier to apply than the more rigid adhesive 38, thereby improving the overall cost effectiveness of the mirror door assembly.

Both adhesives must be chemically inert to the silver coating on the mirror to avoid pinhole blackening of the silver reflective surface of the mirror which may ruin its appearance and usefulness as a mirror. In addition, the moisture barrier provided by the rigid adhesive prevents the atmosphere from chemically attacking and oxidizing the silvered rear face of the mirror, and the protection from the atmosphere is further enhanced by the bead of caulk or an edge sealant such as a lacquer.

The mirror doors currently made by Applicant's assignee pursuant to the present invention are produced as follows:

The doors are hollow core, wooden doors with front and rear skins of wood grained, molded hardboard. The stiles are wood or pressed wood, and the blocking is fiberboard, wood or honeycomb depending upon the location. The mirrors are silvered glass panels without a safety film.

The flexible adhesive is a rubbery block copolymer based thermoplastic hot melt adhesive sold by National Starch and Chemical Company under the designation INSTANT WELD 34-3260. It is applied hot and remains uncured and tacky. It exhibits a tensile strength of 230 psi and an elongation of 1300%.

The rigid adhesive is a reactive urethane based thermosetting adhesive sold by National Starch and Chemical Company under the designation PUR-FECT LOK 70-7892. It reacts with moisture in the air to cure and is thereafter water insoluble. It exhibits a tensile strength of 1400 psi and an elongation of 500%.

Thus, it can be seen from the foregoing detailed description and accompanying drawings that the novel mirror door of the present invention is one in which the adhesive bond secures the mirror rigidly enough to the door to withstand static loads and prevent the movement of the mirror, and also secures most of the mirror surface flexibly to accommodate differential expansion and to dampen impact loads. The adhesive bonding eliminates the synthetic resin safety film now widely employed. The mirror door may be more readily and economically fabricated, and is long lasting.

What is claimed is:

1. A mirror door comprising:

(a) a door having opposed faces, one of which has a recess therein;

(b) a mirror seated in said recess and cooperatively dimensioned therewith to locate its periphery adjacent the periphery of said recess, said mirror having a light reflective front face and a rear face disposed against said door;

(c) a first rigid adhesive disposed between the peripheral portions of said rear face of said mirror and said door recess; and (d) a second adhesive disposed between said mirror and door inwardly of said peripheral portions, said first and second adhesives securing said mirror in said recess of said door, said first adhesive being relatively rigid in comparison to said second adhesive to mount said mirror on said door in a fixed position, and said second adhesive being relatively flexible to accommodate differential expansion between said door and mirror and to dampen impact forces acting between said door and mirror.

2. The mirror door according to claim 1 wherein edge sealant is provided about the periphery of said mirror to effect a seal thereabout.

3. The mirror door according to claim 1 wherein said first adhesive is substantially impermeable to moisture.

4. The mirror door according to claim 1 wherein said mirror is made of glass.

5. The mirror door according to claim 4 wherein said mirror has a silver reflective coating on said rear face and said first and second adhesives are chemically inert to said silver reflective coating.

6. The mirror door according to claim 1 wherein said door is made of wood.

7. The mirror door according to claim 6 wherein said faces of said door are provided by molded hardboard skins.

8. In a method for making a mirror door, the steps comprising:

(a) providing a door having opposed faces with a recess in one of said faces;

(b) providing a mirror dimensioned cooperatively with respect to said recess to locate its periphery adjacent the periphery of said recess, said mirror having a light reflective front face and a rear face; and (c) securing said mirror in said recess of said door by (i) applying a first rigid adhesive between the peripheral portions of said rear face of said mirror and of said door recess and (ii) applying a second adhesive of greater flexibility between said mirror and door inwardly of said peripheral portions, said first adhesive being relatively rigid in comparison to said second adhesive to mount said mirror on said door in a fixed position and said second adhesive being relatively flexible to accommodate differential expansion between said door and mirror and to dampen impact forces acting between said door and mirror.

9. The method for making mirror doors according to claim 8 wherein said first and second adhesives are applied to said mirror before its placement in said recess of said door.

10. The method for making mirror doors according to claim 8 wherein said second adhesive is spaced from said first adhesive.

11. The method for making mirror doors according to claim 8 wherein said door is formed by assembling molded hardboard skins to a frame, one of said skins being molded with said recess.

12. The method for making mirror doors according to claim 8 wherein there is included the step of applying sealant about the periphery of said mirror.

* * * * *